US007318744B2

(12) United States Patent
Kuo

(10) Patent No.: US 7,318,744 B2
(45) Date of Patent: Jan. 15, 2008

(54) POWER CONNECTOR WITH ID IDENTIFYING MEMBER

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/471,430

(22) Filed: Jun. 20, 2006

(65) Prior Publication Data

US 2006/0286852 A1 Dec. 21, 2006

(30) Foreign Application Priority Data

Jun. 21, 2005 (CN) ..... 2005 2 0073035 U

(51) Int. Cl.
*H01R 3/00* (2006.01)

(52) U.S. Cl. ..... 439/489; 439/955; 439/620.03; 439/620.21

(58) Field of Classification Search ..... 439/488, 439/489, 620.01, 620.04, 620.03, 620.21, 439/955

See application file for complete search history.

(56) References Cited

U.S. PATENT DOCUMENTS 5,593,323 A * 1/1997 Dernehl ..... 439/668
6,712,647 B2 * 3/2004 Khemakhem et al. . 439/620.03
2004/0018774 A1 * 1/2004 Long et al. ..... 439/620

* cited by examiner

*Primary Examiner*—Tho D. Ta
*Assistant Examiner*—Vanessa Girardi
(74) *Attorney, Agent, or Firm*—Wei Te Chung

(57) ABSTRACT

A power connector (100) is adapted for connecting with a power input port of an electrical device and includes an insulative housing (1), first and second terminals (2, 3) received in the housing for power transmission, a third terminal (4) received in the housing for signal transmission and a resistor (50) having certain resistance detectable by the electrical device electrically connecting with the second and third terminals. The first and second terminals respectively served as a positive pole and a negative pole of the power connector.

8 Claims, 4 Drawing Sheets

POWER CONNECTOR WITH ID IDENTIFYING MEMBER

CROSS-REFERENCE TO RELATED APPLICATION

Subject matter of this application is related to a copending application entitled "POWER CONNECTOR HAVING REGULATING MEMBER" which is invented by Peter Kuo and assigned to the same assignee as this application.

BACKGROUND OF THE INVENTION

1. Field of the Invention

The present invention relates to an electrical connector, more particularly to a power connector for power transmission.

2. Description of Related Art

Power jacks/plugs are widely used in the electrical industry to connect power supplies with electrical devices, such as mobile phone, note book. The power connector commonly comprises a dielectric housing, an inner contact and an outer contact respectively served as a positive pole and a negative pole of a power supply for powering electrical device connecting with the power connector, and a signal contact provided for signal transmission. The power connectors are classified in many types by specific work voltage thereof, such as 5V, 12V etc, so as to adapt for different applications. However, the outer profiles and the appearance of the power connectors of different types unmatched are similar, therefore, it is possible that the user inserts a power connector to a complementary connector unmatched with the power connector, which results in destroying performance and useful life of the power connector as well as an electrical component to which the complementary connector is assembled to.

Hence, an improved power connector is desired to overcome the disadvantages of the related art.

SUMMARY OF THE INVENTION

Accordingly, an object of the present invention is to provide a power connector which could be identified by an electrical component to which the power connector is connected with the electrical component whether the power connector matches.

In order to achieve the object set forth, a power connector in accordance with the present invention is adapted for connecting with a power input port of an electrical device and comprises an insulative housing, first and second terminals received in the housing for power transmission, a third terminal received in the housing for signal transmission and a resistor having certain resistance detectable by the electrical device electrically connecting with the second and third terminals. The first and second terminals respectively served as a positive pole and a negative pole of the power connector.

Other objects, advantages and novel features of the invention will become more apparent from the following detailed description when taken in conjunction with the accompanying drawings.

DETAILED DESCRIPTION OF THE INVENTION

Figure 1:
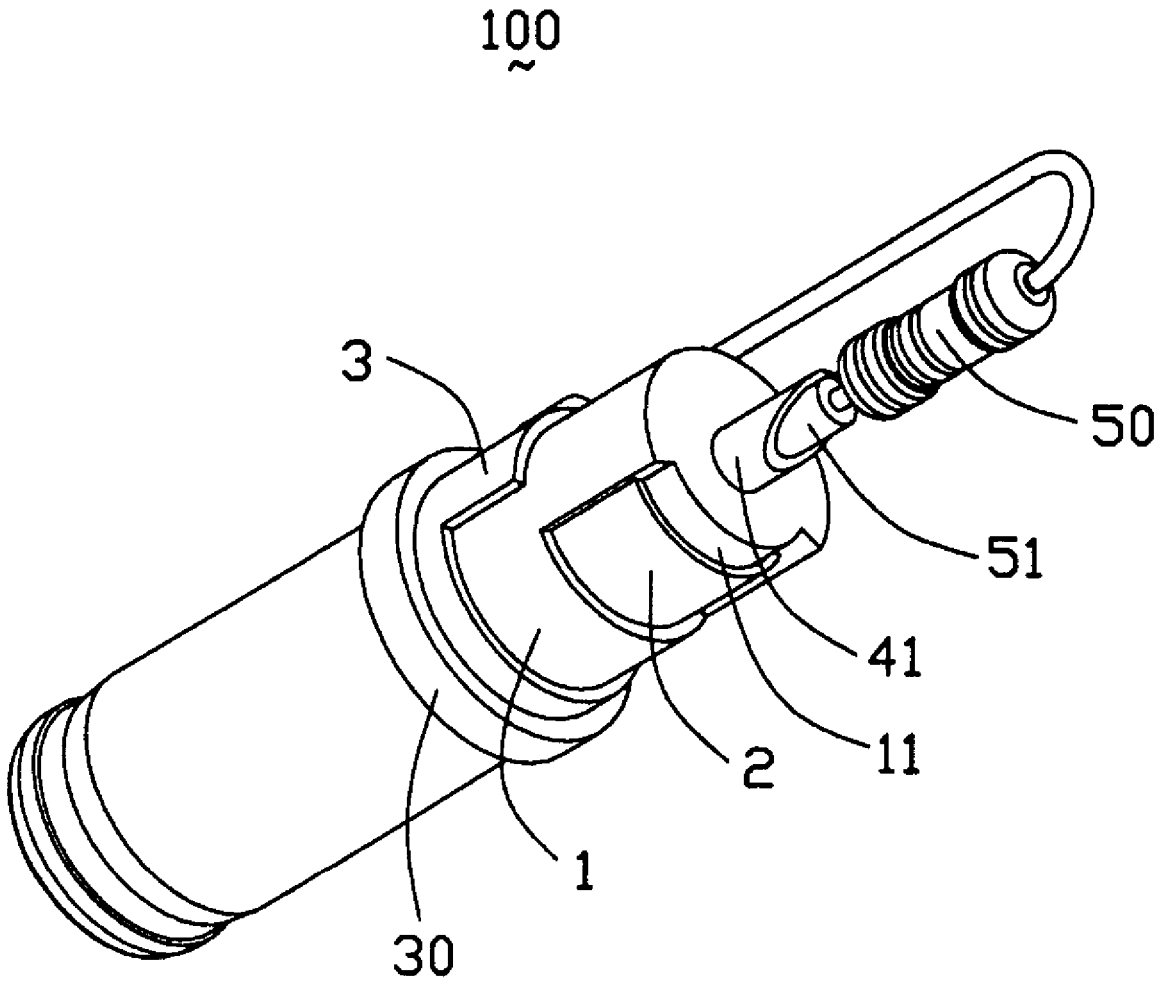
FIG. 1 is an assembled, perspective view of a power connector in accordance with the present invention.

Reference will now be made in detail to the preferred embodiment of the present invention.

Referring to the drawings in greater detail, the power connector 100 in accordance with the present invention matable with a complementary connector, comprises a generally cylindrical insulative housing 1, a pipe shape first terminal 2 assembled within the housing 1, a second pipe-shape terminal 3 sheathing over the housing 1, a third terminal 4 positioned in the center of the housing 1 and a identifying member 5 connecting with the first and third terminals 2, 4.

Figure 2:
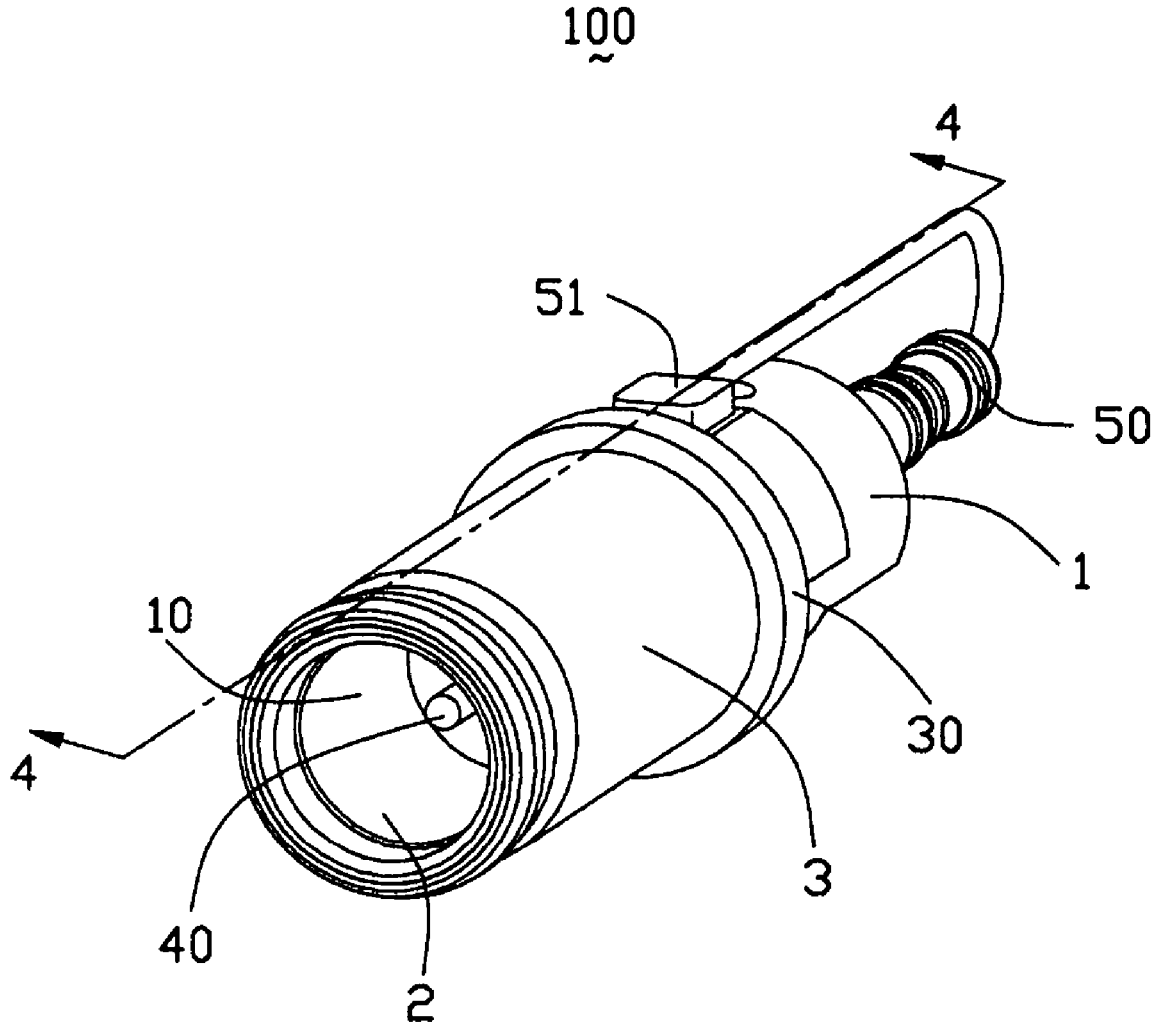
FIG. 2 is a view similar to FIG. 1, but viewed from another aspect.
Figure 3:
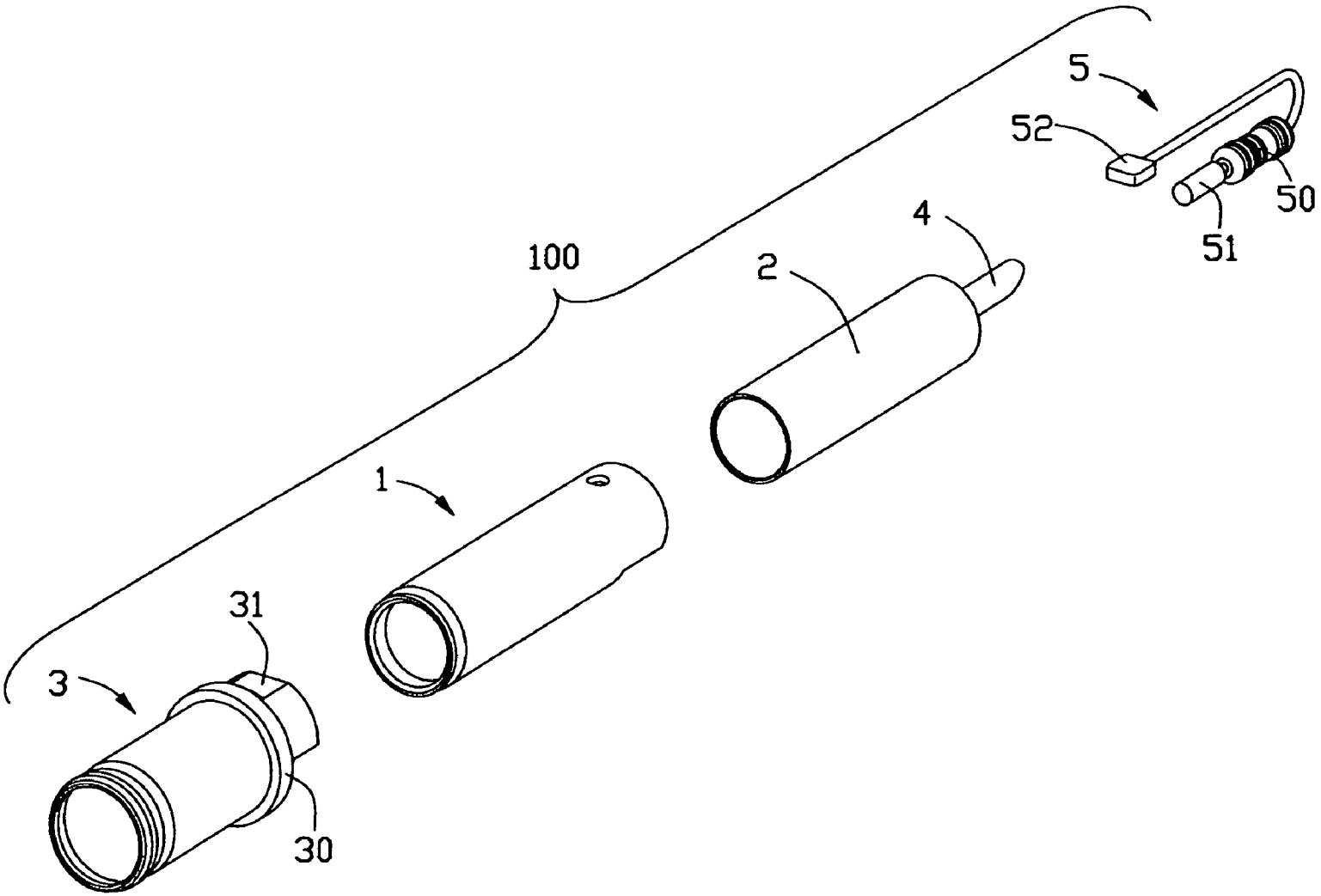
FIG. 3 is an explored, perspective view of FIG. 2.
Figure 4:
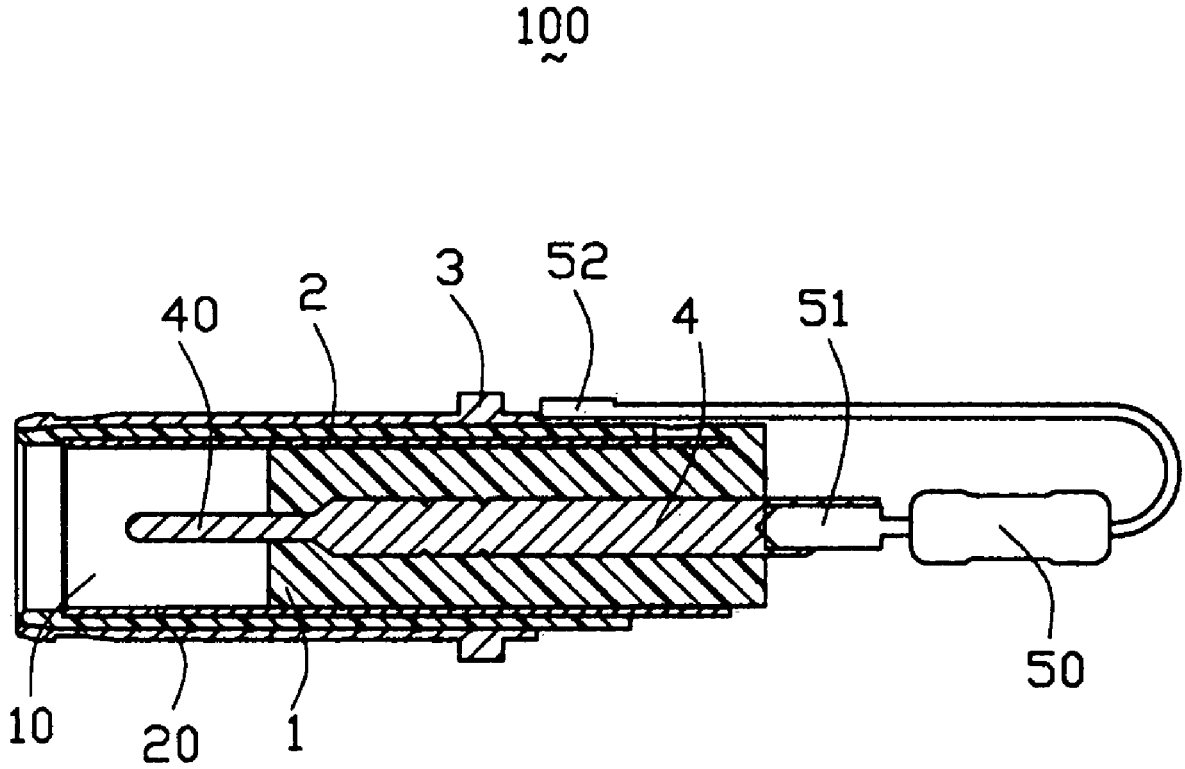
FIG. 4 is a cross-sectional view of FIG. 2 along line 4-4.

Also referring to FIGS. 1-4, the housing 1 is made of synthetic resin by insert molding. The housing 1 defines a receiving cavity 10 at a front portion thereof and a rear cutout 11 partially exposing the first terminal 2. The first and second terminals 2, 3 are configured in metal sleeves with different diameters. The first terminal 2 is functioned as a positive pole of the power connector 100, with front portion thereof attached to an inner surface of the receiving cavity 10 to form a contacting portion 20 contacting with a corresponding portion of the complementary connector. The second terminal 3 is served as a negative pole and comprises a rear annular portion 30 protruding outwardly from outer periphery thereof, a cupulate tail portion (not labeled) rearwardly extending from the annular portion 30 and a flat soldering portion 31 formed on the tail portion. The third terminal 4 is used for signal transmission. The third terminal 4 comprises a contacting portion 40 protruding into the receiving cavity 10 and a U-shaped cupulate connecting portion 41 rearwardly extending from the contacting portion 40 and exposed beyond the housing 1. The identifying member 5 comprises a first column-shape connecting section 51 received in and soldered with the connecting portion 41 of the third terminal 4, a second flat-shape connecting section 52 soldering to the soldering portion 31 of the second terminal 3 and a resistor 50 connecting with the first and second sections 51, 52.

The power connector 100 further comprises a cable (not shown) having a plurality of conductors (not shown) respectively connecting to the first, second and third terminals 2, 3, 4 and an insulating cover (not shown) partially covering the housing 1.

Since the resistor 50 is electrically connected with the negative pole/second terminal 3 and the center third terminal 4, the resistor 50 actually is functioned as a pull down resistor, that is to say, to change resistance of the resistor 50 could change the voltage of the third terminal 4 relative to a ground. When the power connector 100 is mated with the complementary connector, the electrical component with the complementary connector assembled thereon will detect the voltage of the third terminal 4 to identify whether the power connector 100 is the matching type, if not, the electrical component will not run to avoid any undesired impact.

In alternative embodiment, the resistor 50 also can be replaced by other elements, such as capacitor etc. provided for realizing the same function as that of 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector comprising:

an insulative housing;

a power contact disposed on inner side of the housing;

a grounding contact disposed on the other outer side of the housing and isolated from the power contact with the housing; and a signal contact coaxially received within the power contact, the signal contact electrically connected to the grounding contact via an electronic component which performs an identifiable substantial voltage drop phenomenon between the signal contact and the grounding contact so as to allow a complementary connector may identify whether the power connector is a right type for mating;

wherein the signal contact is located in a center of the housing, and the electronic component includes a columnar main body coaxially connected to a rear end of the signal contact.

2. The power connector as claimed in claim 1, wherein the power contact, the grounding contact and the signal contact are coaxially arranged with one another.

3. The power connector as claimed in claim 1, wherein said a connection between the grounding contact and the signal contact defines a U-shaped configuration.

4. The power connector as claimed in claim 1, wherein the electronic component is electrically and electrically fixed to only the signal contact and the grounding contact at two opposite ends thereof without involvement with any printed circuit board.

5. The power connector as claimed in claim 1, wherein said electronic component essentially extends in a U-shaped manner.

6. A method of detecting a power connector, comprising steps of:

providing a power connector with power, signal and grounding contacts spaced from one another;

providing an Insulative housing to isolate the power contact from the grounding contact; and electrically, connecting said signal contact to said grounding contact via an electronic component; wherein said electronic component experiences an energy change so as to change the output signal of the signal contact; wherein the electronic component is mechanically and electrically fixed to only the signal contact and the grounding contact at two opposite ends thereof without involvement with any printed circuit board;

wherein the signal contact is located in a center of the housing, and the electronic component includes a columnar main body coaxially connected to a rear end of the signal contact.

7. The method of claim 6, wherein said signal contact performs a specific voltage level according to a property of said.

8. The method of claim 6, wherein said electronic component essentially extends in a U-shaped manner.

* * * * *